United States Patent [19]

Enkner et al.

[11] Patent Number: 4,678,168

[45] Date of Patent: Jul. 7, 1987

[54] TILTING CHANNEL ARRANGEMENT FOR GUIDING A MOLTEN MATERIAL

[75] Inventors: Bernhard Enkner; Leopold Amon, both of Linz; Alfred Kübelböck, Zwettl/Rodl; Wolfgang Trimmel, Leoben; Paul Nalepka, Niklasdorf; Leopold Schropp, Linz; Helmut Schwaighofer, Neumarkt; Reinhard Pum, Linz; Manfred Traxler, Hart; Franz Tasch, Bad Mitterndorf, all of Austria

[73] Assignee: Voest-Alpine Aktiengesellschaft, Linz, Austria

[21] Appl. No.: 775,536

[22] Filed: Sep. 13, 1985

[30] Foreign Application Priority Data

Sep. 18, 1984 [AT] Austria ..... 2965/84

[51] Int. Cl.[4] ..... F27D 3/15

[52] U.S. Cl. ..... 266/196; 164/337; 222/604; 266/236

[58] Field of Search ..... 266/196, 236; 75/46; 164/337; 222/591, 592, 594, 604

[56] References Cited

U.S. PATENT DOCUMENTS 1,061,280 5/1913 Ford ..... 266/196
1,881,228 10/1932 Pape ..... 164/337

FOREIGN PATENT DOCUMENTS 628234 4/1936 Fed. Rep. of Germany .

*Primary Examiner*—Melvyn J. Andrews
*Attorney, Agent, or Firm*—Hopgood, Calimafde, Kalil, Blaustein & Judlowe

[57] ABSTRACT

A tilting channel for guiding molten material includes a trough-shaped channel body provided with outlets at opposite ends thereof and a spot of impact for the jet of molten material between said outlets. The channel body is pivotable by means of a pivot drive about a tilting axle from a normal operation position into an emergency operation position, and vice versa. The channel body is formed by two channel parts enclosing an angle $0<\phi<180°$, and the bottom of the first channel part is arranged at a lower level relative to the bottom of the second channel part. The spot of impact of the jet is located on the first channel part close to where the latter enters into the second channel part, and the vertical middle plane of the first channel part lies in the plane formed by the jet, when the first channel part is in its downwardly inclined normal operating position.

12 Claims, 5 Drawing Figures

FIG. 2
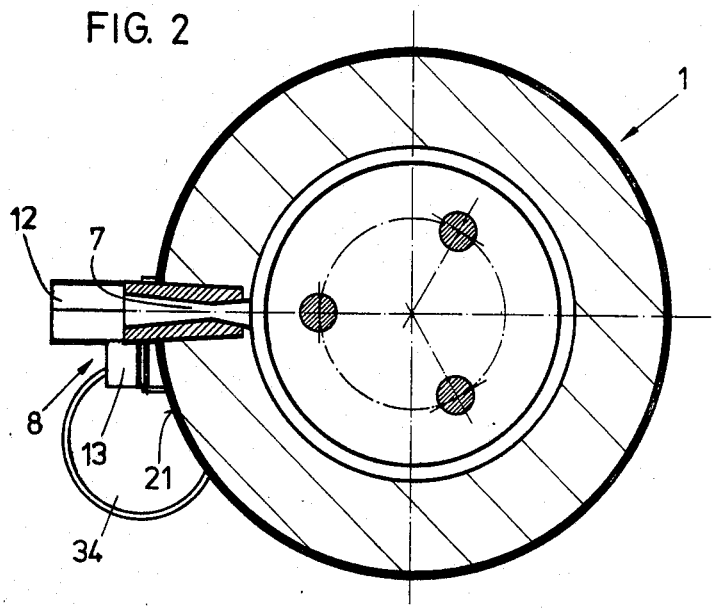
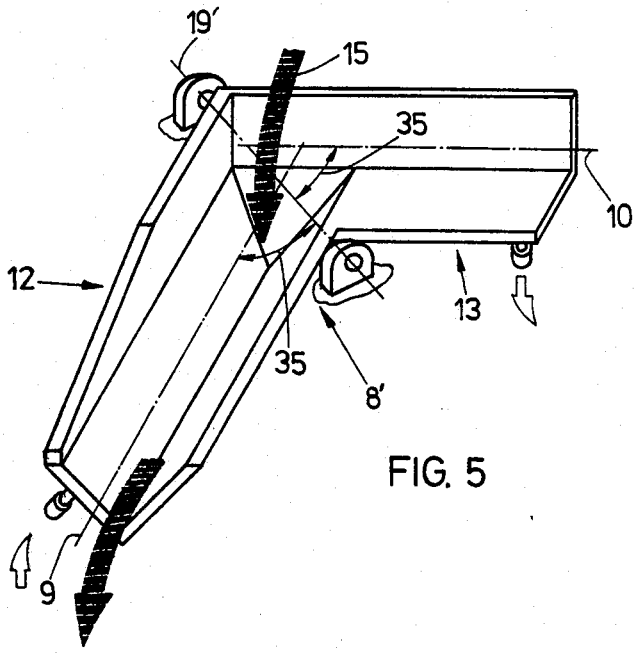
FIG. 5

TILTING CHANNEL ARRANGEMENT FOR GUIDING A MOLTEN MATERIAL

The invention relates to a tilting channel for guiding molten material, in particular mineral materials capable of being spun, such as slag, and including a trough-shaped channel body provided with outlets at opposite ends thereof, said channel body having a spot of impact for a jet of molten material between the endside outlets, the channel body being pivotable about a tilting axis by means of a pivot drive from a normal operation position into an emergency operation position, and vice versa.

A tilting channel is known e.g. from German patent No. 628,234. It serves for guiding the molten material hitting the tilting channel in a jet selectively into different directions and thus into different vessels. The spot of impact of the jet is subjected to a particularly high thermal load in tilting channels. Furthermore, the striking jet causes erosions of the refractory lining of the known channel at the spot of impact and thus a contamination of the melt with refractory material. At the spot of impact the refractory lining must be renewed at short intervals. This is particularly so, if the jet of molten material emerges approximately horizontal from a metallurgical vessel, since in that case the longitudinal axis of the tilting channel must be arranged approximately transversely to the plane of the jet. In that case, at the spot of the impact of the jet there additionally occurs a deflection of the molten material by approximately 90° from the plane of the jet, whereby the spot of impact is subjected to a particularly high wear and the tilting channel has to be relined accordingly frequently.

The invention aims at avoiding these disadvantages and difficulties and has as its object to provide a tilting channel of the initially defined kind, in which the spot of impact of the jet has approximately an equally long useful life as the remaining channel and in which in the operating position, i.e. in the tilting position mainly used, a deflection of the pouring jet out of its plane is avoided.

According to the invention, this object is achieved in that the trough-shaped channel body is formed by two channel parts whose longitudinal axes enclose an angle $0<\phi<180°$ preferably an approximately right angle, wherein the bottom of a first channel part is arranged so as to be at a lower level relative to the bottom of the second channel part, the spot of impact of the jet on the first channel part is close to the entry into the second channel part, and the vertical middle plane of the first channel part lies in the plane formed by the jet when the first channel part is in its downwardly inclined normal operation position.

Due to the angular design of the channel body it is possible to arrange one of the channel parts of the channel body, i.e. that which is flowed through in the normal operation of the tilting channel, in the plane of the jet of molten material, so that a deflection of the jet out of its plane, and thus erosions, are largely prevented. By arranging the spot of impact at the bottom of one of the channel parts having the lower level, a sump of molten material occurs at the spot of impact after tilting of the channel in the emergency operation position, on which sump the jet impinges, and thus the jet does not hit a channel wall and erosions are largely avoided also in that position of the tilting channel.

An embodiment of particularly simple construction is characterized in that the second channel part is arranged such that its longitudinal axis is parallel to the tilting axle.

A further preferred embodiment in which the tilting drive substantially need not perform any lifting work is characterized in that the longitudinal axes of both channel parts enclose an acute angle with the tilting axle, preferably an angle of 45°, the tilting axle being provided in the region of the entry of the first channel part into the second channel part. The two channel parts approximately keep the balance about the tilting axle, so that the pivot drive only has to overcome the moment of inertia of the tilting channel about the tilting axle, when pivoting, or has to safely hold the tilting channel in its different positions.

Preferably, the first channel part is arranged rotated about its longitudinal axis relative to the second channel part.

An easy-to-produce embodiment is characterized in that the channel parts have a V-shaped cross-section standing on its tip when the melt flows through and are each formed by two side walls being at equal angles to each other, preferably being at right angles to each other, one side wall of the second channel part is arranged at a higher level verging into the upper edge of a side wall of the first channel part.

For avoiding splashing of the molten material out of the tilting channel in the emergency operation position, one side wall of the second channel part that is arranged at a higher level verges into a wall portion rising above the side wall of the first channel part.

Preferably the side walls are designed so as to be hollow and are provided with a water cooling resulting in the advantage that a layer of solidified material forms at the inner sides of the channel body, i.e. an insulation of equal kind which makes it unnecessary to prodive a lining and prevents a contamination of the molten material by foreign material.

The invention shall now be explained in more detail by way of two exemplary embodiments, wherein FIG. 1 is a section through an electric furnace to whose outlet the tilting channel of the invention is mounted according to a first embodiment;

FIG. 2 is a section through the furnace along line II—II of FIG. 1;

FIG. 5 shows a further embodiment of the tilting channel in an illustration analogous to that of FIG. 3.

Figure 1:
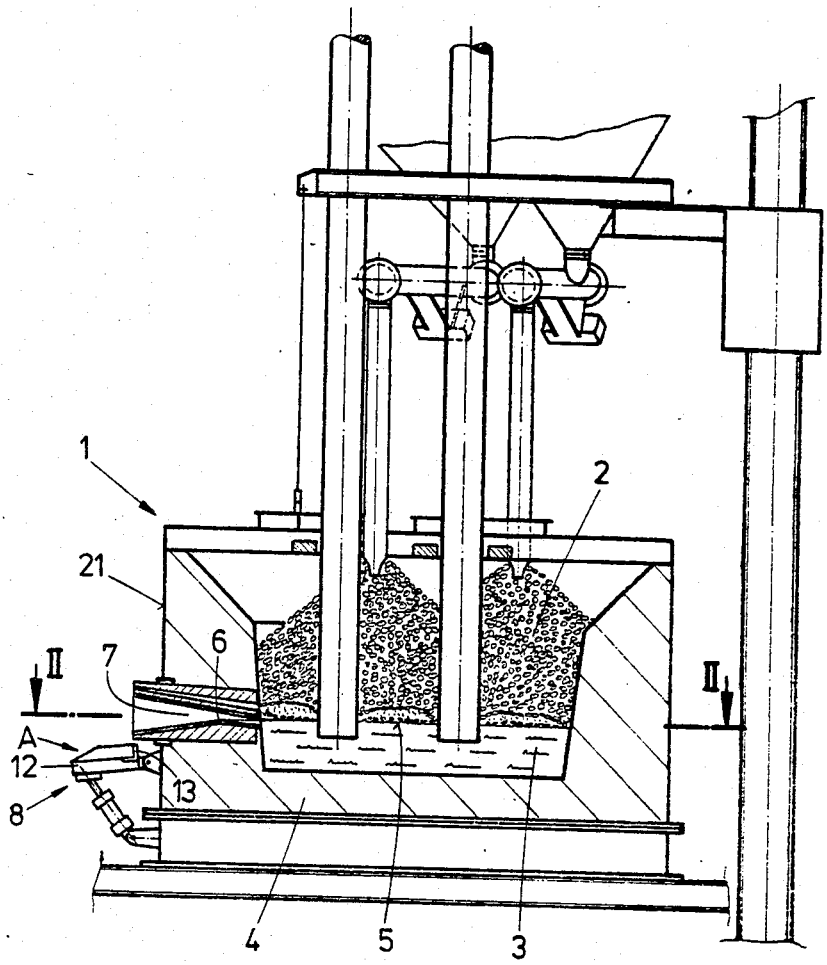

The materials 2 molten in an electric furnace 1 collect at the bottom 4 of the electric furnace 1 as melt 3. As soon as the pouring level 5 reaches the lower edge 6 of the tap hole 7, melt 3 flows through the tap hole 7 out of the electric furnace 1. There is the problem of guiding the melt 3 emerging at the beginning from the tap hole 7 into an emergency collecting container, since the melt 3 contains contaminations at the beginning and, must not reach a spinner, e.g., arranged therebehind for spinning the melt.

For enabling a selective guiding of the molten material into an emergency collecting container or to further normal processing, a tilting channel 8 is provided below the tap hole 7, the tilting channel having two channel parts 12, 13 whose longitudinal axes 9, 10 enclose an approximately right angle 11, wherein the bottom 14 of the first channel part 12 extending in the direction of the jet 15 emerging from the tap hole 7 is arranged at a lower level relative to the bottom 16 of the second channel part 13 arranged at a right angle thereto and thus approximately at a right angle to the plane 17 of the jet 15. The tilting channel 8 is fastened to the electric furnace such that the spot of impact 18 of the jet lies in the first channel part 12, i.e. close to its entry into the second channel part 13.

The tilting channel 8 is pivotable about a tilting axle 19 arranged parallel to the second channel part 13 and mounted on the electric furnace 1 by means of two consoles 20 fastened to the furnace shell 21. For pivoting the tilting channel, a pivoting drive 22 is provided, which is designed as pressure medium cylinder and is hinged near the outlet 23 of the first channel part 12, on the one hand, and to the furnace shell 21, on the other hand.

Figure 3:
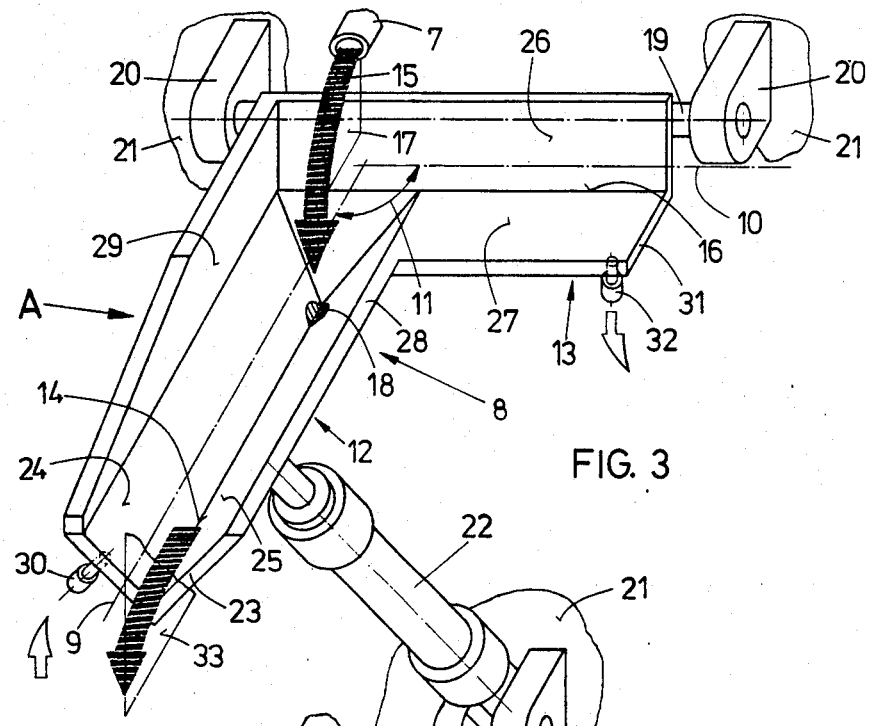
FIGS. 3 and 4 illustrate the tilting channel of the first embodiment on an enlarged scale in isometric views in different tilting positions.
Figure 4:
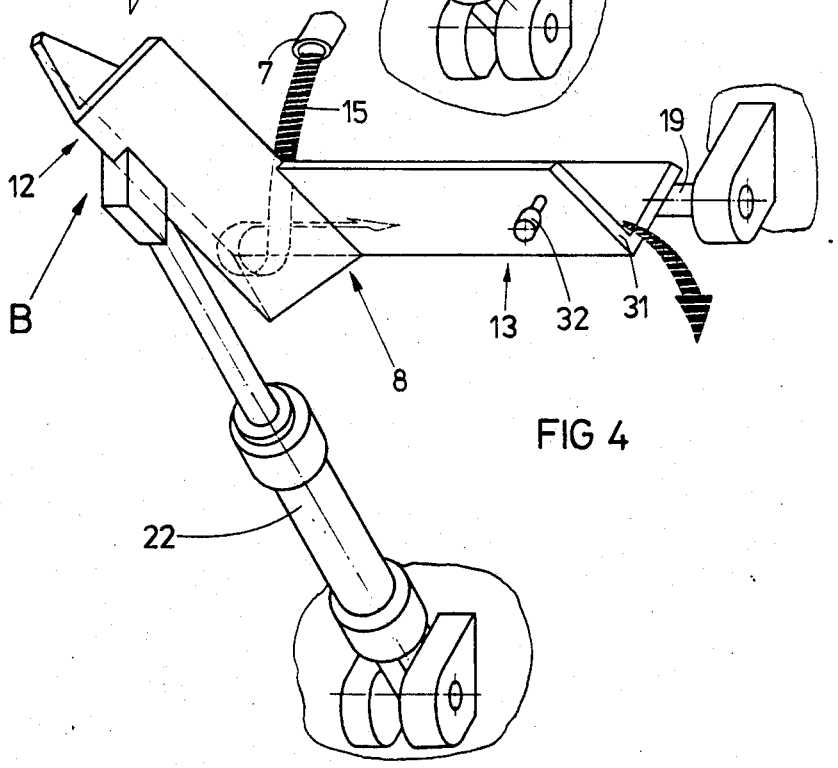

As can be seen from FIGS. 3 and 4, both channel parts 12, 13 have V-shaped cross-sections, the side walls 24, 25, 26, 27 of the channel parts 12, 13 being each formed by two hollow plates arranged at right angles to each other and flowed through by coolant. The first channel part 12 is arranged rotated about its longitudinal axis 9 relative to the second channel part 13, the side wall 27 of the second channel part 13 arranged at a higher level verging into the upper edge 28 of the side wall 25 of the first channel part 12. The second side wall 26 of the second channel part 13 abuts a wall portion 29 rising above the respective side wall 24 of the first channel part 12. Close to its outlet 23, the first channel part 12 has a coolant supply connection piece 30, the coolant thus flowing through this channel part 12 counter to the flow direction of the molten material. Subsequently, the coolant reaches the second channel part 13, from whence is leaves through the outlet connection piece 32 arranged at the outlet 31 of the second channel part 13.

The tilting channel functions in the following manner:

In the normal operation position A, illustrated in FIGS. 1, 2 and 3, the jet 15 flows into the first channel part 12, the jet not being deflected out of its plane 17, since, as can be seen from FIG. 3, the vertical middle plane 33 of the first channel part 12, in the downwardly inclined position of that channel part (i.e. in the position of normal operation A), lies in the plane 17 formed by the jet 15. In the emergency operation position B, illustrated in FIG. 4, which must be assumed if the molten material is not to get to the means following upon the outlet 23 of the first channel part, to a spinner, e.g.,—i.e. at the beginning of the operation (contaminated melt) or in case of disturbances of the electric furnace 1 or of the spinner—the spot of impact 18 of the pouring jet 15 is still in the first channel part 12, as it is if the tilting channel 8 is in the normal operation position A. However, the first channel part 12 that is upwardly directed in the emergency operation position B causes a sump to be formed above the spot of impact 18, and it is only after entry into the sump that the molten material gets into the second channel part 13 guiding the molten material to an emergency collecting container 34.

According to the embodiment illustrated in FIG. 5, the tilting axis 19' of the tilting channel 8' is no longer arranged parallel to the second channel part 13, but it encloses an acute angle 35 with each of the two longitudinal axes 9 and 10 of the channel parts 12 and 13, which acute angle has approximately 45°. Furthermore, the tilting axis 19' is not horizontal, as illustrated in FIG. 1, but arranged so as to lie slanted in space, and it extends approximately through the center of gravity of the tilting channel 8'. By this the tilting channel 8' is pivotable with little expenditure of force.

The invention is not limited to the exemplary embodiments illustrated in the drawings, but may be modified in various respects. The cross-section of the channel parts may be of rectangular or trapezoidal shape. The angle that the two channel parts enclose with each other, advantageously is a right angle, yet the two channel parts may also enclose an angle deviating therefrom. This angle depends on the local situation, i.e. on the space available.

What we claim is:

1. A tilting channel arrangement for guiding a stream of molten material as it is being discharged from a tap hole in the side of a metallurgical vessel, said tilting channel arrangement having two branches extending divergently at an angle of less than 180° from a common origin to respective outlet ends, each branch consisting of a linear channel, one of said branch channels having a bottom which, when said branch channel is positioned for conveying said material away from said origin to its outlet end, is located at a lower level than the bottom of said other branch channel, said tilting channel arrangement being provided with a tiltable mount for securing the tilting channel arrangement in a first position beneath said tap hole with said one branch channel having its longitudinal axis aligned with the plane of the trajectory of said material when issuing from said tap hole and with said origin located beneath said tap hole for receiving issuing material at a point of impact in the vicinity of said origin, said tiltable mount being constructed to provide a tilting axis about which said tilting channel arrangement can be rotated selectably from said first position to a second position where said outlet end of said one branch channel is elevated sufficiently to cause any material that issues from said tap hole to accumulate in the vicinity of said point of impact and enter said other branch channel which has moved into position for conveying said material toward its said outlet end.

2. A tilting channel arrangement as set forth in claim 1, wherein said tilting channel arrangement is constructed to convey molten material which is a mineral material capable of being spun.

3. A tilting channel arrangement as set forth in claim 2, wherein said material is slag.

4. A tilting channel arrangement as set forth in claim 1, wherein said angle between said branch channels is approximately a right angle.

5. A tilting channel arrangement as set forth in claim 1, wherein the longitudinal axis of said other branch channel is positioned parallel to said tilting axis.

6. A tilting channel arrangement as set forth in claim 1, wherein said tilting axis is located traversing said origin and the included angles between the longitudinal axes of said two branch channels and said tilting axis are acute angles.

7. A tilting channel arrangement as set forth in claim 6, wherein said acute angle is substantially 45°.

8. A tilting channel arrangement as set forth in claim 1, wherein said other branch channel is oriented relative to said one branch channel such that when the latter is upright in fluid carrying position, the former is located on its side.

9. A tilting channel arrangement as set forth in claim 1, wherein said two branch channels each have a V-shaped cross-section and each is disposed apex down when said molten material flows therethrough, each of said branch channels being formed by two side walls, one side wall of said other branch channel merging into an upper edge of one side wall of said one branch channel.

10. A tilting channel arrangement as set forth in claim 9, wherein said two side walls of each branch channel are located at a right angle to each other.

11. A tilting channel arrangement as set forth in claim 9 or 10, further comprising a further wall portion rising above the other side wall of said one branch channel, and the other side wall of said other branch channel merges into said further wall portion.

12. A tilting channel arrangement as set forth in claim 1, wherein said branch channels are formed by side walls of hollow construction and means are provided for circulating cooling water through said hollow side walls.

* * * * *